US005638102A

United States Patent [19]

Kawai

[11] Patent Number: 5,638,102

[45] Date of Patent: Jun. 10, 1997

[54] PRINTER COMPRISING A STACK OF STRAIN RESPONSIVE AND VOLTAGE RESPONSIVE FILMS

[75] Inventor: Jun Kawai, Tokyo, Japan

[73] Assignee: NEC Corporation, Tokyo, Japan

[21] Appl. No.: 363,831

[22] Filed: Dec. 27, 1994

[30] Foreign Application Priority Data

Dec. 29, 1993 [JP] Japan ..... 5-351530

[51] Int. Cl.[6] ..... B41J 2/39; B41J 2/395; B41J 2/40

[52] U.S. Cl. ..... 347/141; 347/153; 347/264

[58] Field of Search ..... 347/141, 153, 347/159, 238, 264, 112

[56] References Cited

FOREIGN PATENT DOCUMENTS

| | | |
|---|---|---|
| 62-269155 | 11/1987 | Japan . |
| 62-269156 | 11/1987 | Japan . |
| 63-18369 | 1/1988 | Japan . |
| 63-220177 | 9/1988 | Japan . |

*Primary Examiner*—Mark J. Reinhart
*Assistant Examiner*—L. Anderson
*Attorney, Agent, or Firm*—Whitham, Curtis, Whitham & McGinn

[57] ABSTRACT

In a page or a line printer, a printer head comprises a resilient substrate, as of borosilicate glass, a strain responsive film of a first ferroelectric material, such as lead zirconate titanate, on the substrate, and a voltage responsive film of a second ferroelectric material, such as lead lanthanum zirconate titanate, on the strain responsive film to form a stack. Responsive to a driving signal representative of a pattern, a piezoelectric driving member inverts, into an inverted residual polarization representative of the pattern as a latent image, an initial residual polarization which is preliminarily produced in the voltage responsive film in its thickness direction by application of a driving voltage to the piezoelectric driving electrode member. The signal or the voltage produces in the substrate a travelling elastic wave which gives a strain and an electric voltage in compliance with the strain. The electric voltage gives rise to the residual polarization. Preliminary charged to a polarity opposite to that of the latent image, an electrostatic toner is supplied to a first end of the voltage responsive film and moved towards a second end by a travelling elastic wave produced in the substrate concurrently with supply of the toner to the first end by supplying a signal to the piezoelectric driving electrode member for production of a toner moving travelling elastic wave.

20 Claims, 8 Drawing Sheets

PRINTER COMPRISING A STACK OF STRAIN RESPONSIVE AND VOLTAGE RESPONSIVE FILMS

BACKGROUND OF THE INVENTION:

This invention relates to a printer for use in information processing and electric communication and a method of developing a latent image printed on the printer.

For use in a personal terminal device or in a monitor, a page or a line printer is preferably capable of printing a clear print at a high speed and quietly. The printer should furthermore be small-sized, simple in structure, and suitable for production on a large scale.

An impact printer is operable to print out an image on a usual paper and is adapted to general purposes. The impact printer is, however, noisy and operable to print unclear and at a low speed. As a consequence, either an ink-jet printer or a thermographic printer is used in many cases.

For a higher clarity and a higher speed, electrophotographic printers are in practical use. In such an electrophotographic printer, use is made of an electrostatic latent image or an image of residual polarization in a ferroelectric layer.

Among the printers described in the foregoing, the thermographic printer and the ink-jet printer are suitable for use as a built-in printer of a personal computer. That is, either of the thermographic and the ink-jet printers is simple in structure and compact and is, above all, of a small height.

use of the residual polarization in a ferroelectric layer is disclosed in, for example, Japanese Patent Prepublications (A) Nos. 269,155 of 1987, 269,156 of 1987, and 18,369 of 1988. In each of these prior patent applications, the ferroelectric layer is formed either on a drum or a movable plate. Polarization in the ferroelectric layer is inverted either electrically or both thermally and electrically into a latent image of residual polarization. For supply of an electrostatic toner to the latent image, a developing device comprises a specific brush.

Use of the residual polarization is revealed also in Japanese patent Prepublication (A) No. 220,177 of 1988. In this printer, the ferroelectric layer is formed on an electroconductive substrate. Polarization in this ferroelectric layer is electrically inverted. It is possible to get a plurality of prints from a single latent image.

At any rate, use of such residual polarization in a ferroelectric layer or film is excellent. This is because, the latent image is developed with use of neither a high voltage generator nor a large-capacity memory for processing the image.

Conventional printers of this residual polarization type are, however, defective in several points. In the manner described above, the residual polarization is controlled either electrically or thermally. It is therefore necessary to put either an electrode or a head for electric or thermal processing in a position where the residual polarization is inverted. Alternatively, the ferroelectric layer must be put near to the electrode or the head. For high-speed printing, such movement must be rapid and precise. In addition, the printer becomes bulky and difficult to implement as the height is reduced.

Furthermore, the residual polarization has been inverted by application of an electric field to the ferroelectric layer. For this purpose, the ferroelectric layer must be either brought into contact with an electrode or subjected to electric discharge in, for example, gas. Use of the thermal processing must similarly be carried out. This results in a wear-out or a damage of the ferroelectric layer and eventually in a short serviceable life of the printer.

SUMMARY OF THE INVENTION

It is consequently an object of the present invention to provide a printer which may be either a page or a line printer and is operable by using residual electric polarization in a polarization in a ferroelectric film or layer.

It is another object of this invention to provide a printer which is of the type described and which is compact and has a low height, It is still another object of this invention to provide a printer which is of the type described and in which an electrostatic latent image is produced by inverted residual electric polarization without wearing or damaging the printer.

It is yet another object of this invention to provide a printer which is of the type described and by which the latent image is readily developed on a paper or a like medium.

It is a further object of this invention to provide a method of developing a latent image produced in a printer of the type described.

Other objects of this invention will become clear as the description proceeds.

In accordance with an aspect of this invention, there is provided a printer comprising a printer head which comprises in turn: (A) a piezoelectric substrate; (B) a strain responsive film of a first ferroelectric material on the substrate; (C) a voltage responsive film of a second ferroelectric material on the strain responsive film to form a stack of ferroelectric films in cooperation with the strain responsive film; and (D) a piezoelectric driving electrode member responsive to a driving signal representative of a pattern for inverting an initial residual polarization in the voltage responsive film into an inverted residual polarization in a thickness direction of the voltage responsive film to make an area of the inverted residual polarization serve as a latent image of the pattern.

Each of the first and the second ferroelectric materials is preferably a perovskite compound of lead zirconate titanate (PZT). The strain responsive film responds to a strain applied thereto to produce a voltage and is made of, for example, the lead zirconate titanate. The voltage responsive film respond to the voltage produced in the strain responsive film, gives rise to inversion of the initial residual polarization into the inverted residual polarization, and is made of, for example, lead lanthanum zirconate titanate (PLZT). The pattern represents letters and/or a figure.

In accordance with a different aspect of this invention, there is provided a method of developing a latent image which is produced as a pattern of inverted residual polarization with a first polarity in a thickness direction of a voltage responsive film of a first ferroelectric material stacked on a strain responsive film of a second ferroelectric material formed on a resilient substrate as a stack of ferroelectric films of a printer head in cooperation with the voltage responsive film by a piezoelectric driving electrode member for supplying the stack with a driving voltage representative of the pattern to invert an initial polarization in conformity with the pattern, which method comprises the step of supplying an electrostatic toner of a second polarity opposite to the first polarity onto the voltage responsive film.

It should be noted in connection with the above that the method is set forth with the voltage responsive film first recited. The first and the second ferroelectric materials are therefore the second and the first ferroelectric materials of the printer set forth before.

DESCRIPTION OF THE PREFERRED EMBODIMENTS

Figure 1:
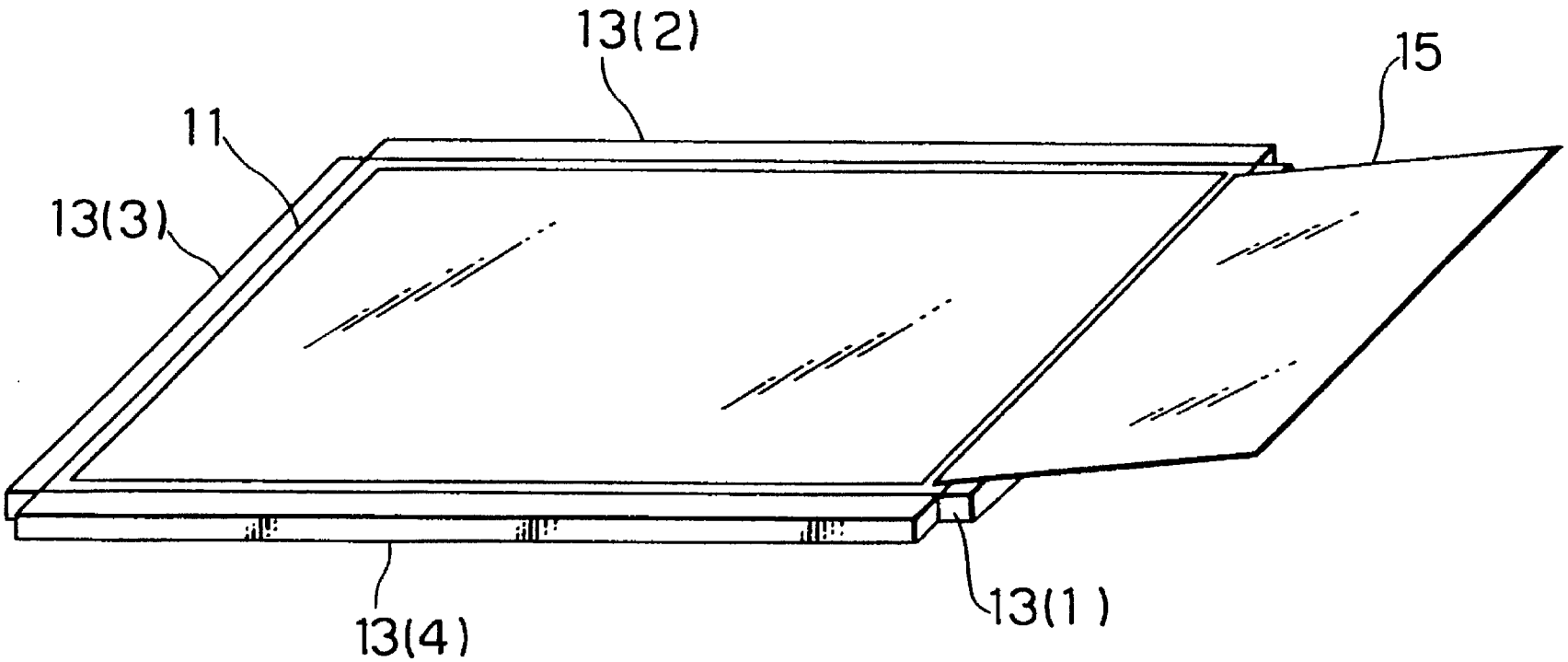
FIG. 1 is a perspective view of a printer head of a printer according to a first embodiment of the instant invention.

Referring to FIG. 1, the description will start with a printer head of a printer according to a first preferred embodiment of the present invention. The printer is a page printer and comprises, besides the printer head, a power supply arrangement which is for supplying electric power to the printer head as will become clear as the description proceeds. The printer furthermore comprises a toner reservoir and a recording medium supply arrangement which are known in the art. The printer head is of the type in which residual polarization is inverted like in a conventional printer head.

The printer head comprises a resilient substrate 11 which is typically a borosilicate glass substrate and is, for example, 306 mm long, 220 mm wide, and 1 mm thick and has a surface roughness or smoothness of less than 0.1 micrometer. A stack of two ferroelectric films is formed on the resilient substrate 11 in the manner which will presently be described. In a typical example, the stack is 296 mm in length and 210 mm in width.

The resilient substrate 11 has first through fourth side surfaces. First through fourth piezoelectric electrode pieces 13(1), 13(2), 13(3), and 13(4) are attached to the first through the fourth side surfaces. Depending on the circumstances, the piezoelectric electrode pieces will either collectively or singly be designated by a simpler reference numeral 13 with omission of the suffixes enclosed with parentheses. Each piezoelectric electrode piece 13 has a cross-sectional area of 1 mm by 1 mm. From an end of the stack, an aluminium plate 15 is extended outwardly of the resilient substrate 11. The aluminium plate 15 is for receiving an electrostatic toner as a toner supplier and is typically 0.3 mm thick.

Figure 2:
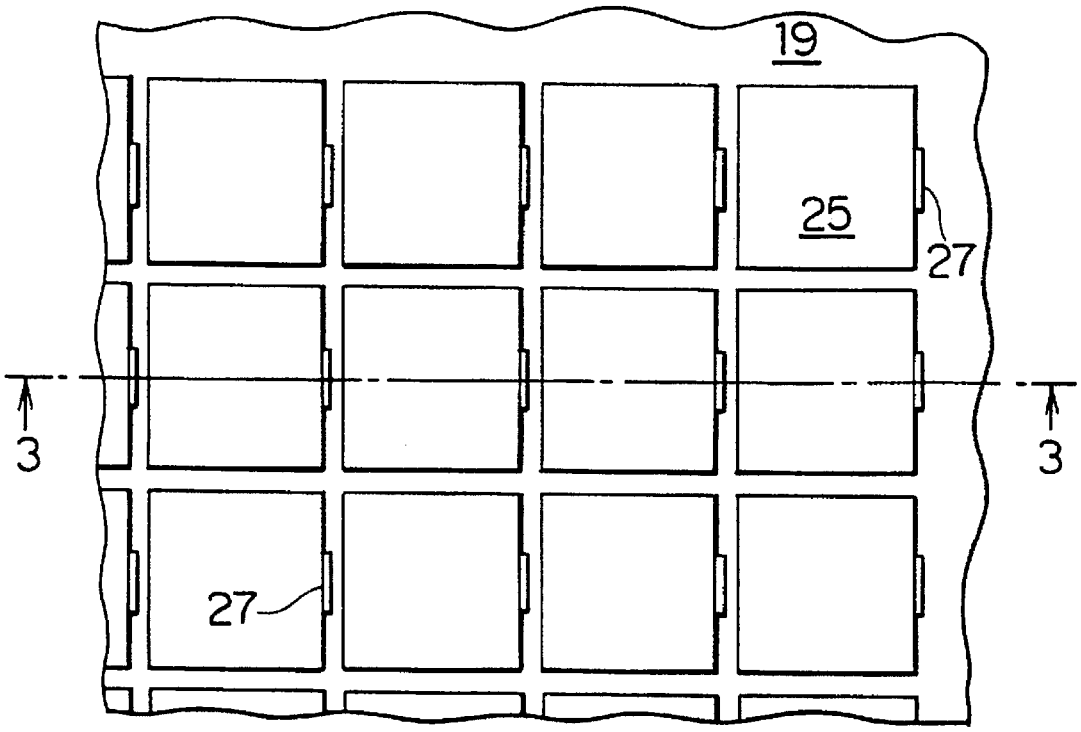
FIG. 2 is a top view of a part of the printer head illustrated in FIG. 1.
Figure 3:
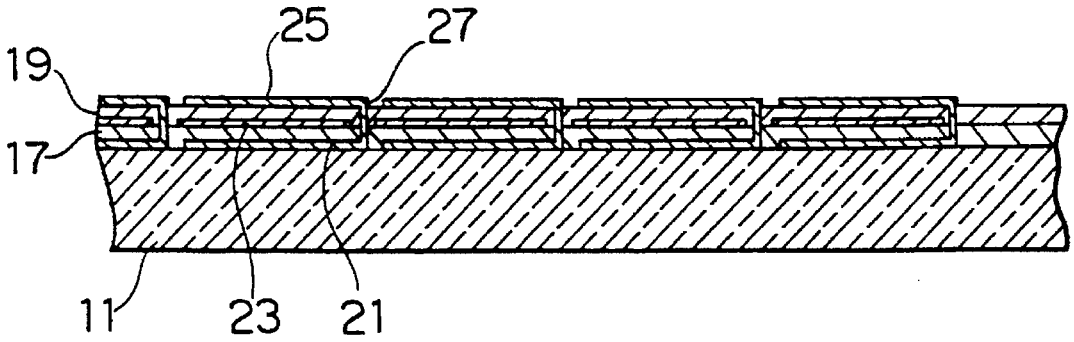
FIG. 3 is a schematic sectional view taken on line 3—3 of FIG. 2.

Referring to FIGS. 2 and 3 in addition to FIG. 1, a strain responsive or sensitive film 17 of a first ferroelectric material is formed on the resilient substrate 11 as will shortly be described in detail. A voltage responsive or sensitive film 19 of a second ferroelectric material is stacked on the strain responsive film 17 to form the stack of two ferroelectric films in cooperation with the strain responsive film 17. In the manner described heretobefore, the strain responsive film 17 responds to a strain applied thereto to produce an electric voltage. The voltage responsive film 19 responds to the voltage produced in the strain responsive film 17 and gives rise to residual polarization in a direction of the thickness of the voltage responsive film 19. Typically, each of the strain and the voltage responsive films 17 and 19 is 1.2 micrometers thick. Preferably, the first and the second ferroelectric materials are lead zirconate titanate (PZT) and lead lanthanum zirconate titanate (PLZT) or lanthanum-doped lead zirconate titanate of chemical compositions:

$$Pb(Zr_{0.45}Ti_{0.55})O_3$$

and $$Pb_{0.938}La_{0.063}(Zr_{0.6}Ti_{0.4})_{0.9840}O_3.$$

Between the resilient substrate 11 and the strain responsive film 17, interposed are lower electrode layers 21. Between the strain and the voltage responsive films 17 and 19, laid are common electrode layers 23. On the voltage responsive film 19, extended are upper electrode layers 25. The lower and the upper electrode layers 21 and 25 are connected by connection electrode layers 27 which extend through the strain and the voltage responsive films 17 and 19. Each of the lower, the common, and the upper electrode layers 21 through 25 are made preferably of gold and is typically about 500 angstroms thick. The connection electrode layers 27 are formed by a usual through hole method The lower and the upper electrode layers 21 and 25 and the connection electrode layers 29 are not electrically connected to the piezoelectric electrode pieces 13 but are electrically floating in this meaning from the electrode pieces 13. The common electrode layers 23 are similarly floating.

In FIGS. 2 and 3, the lower and the upper electrode layers 21 and 25 are arranged in an array. With the strain and the voltage responsive films 17 and 19 and each common electrode film 23 interposed, each pair of the lower and the upper electrode layers 21 and 25 has a common shape and is connected by one of the connection electrode layers 27. The lower electrode layers 21 and consequently the upper electrode layers 25 are formed with a pitch of eighteen per 1 mm vertically and horizontally of FIG. 2. This pitch corresponds to about 457 DPI and is capable of attaining a high resolution.

On manufacturing the printer head, the lower electrode films 21 are first formed on the resilient substrate 11 in any of many commonly known manners. The first ferromagnetic material is sputtered onto the lower electrode layers 21 to form the strain responsive film 17. After the common electrode layers 23 are formed on the strain responsive film 17, the second ferroelectric material is sputtered onto the common electrode layers 23 to provide the voltage responsive film 19. Subsequently, the upper electrode layers 25 are formed on the voltage responsive film 19 with the connection electrode layers 27.

In FIG. 1, the piezoelectric electrode pieces 13 preferably have a large piezoelectric constant and are made of NEPEC 10 manufactured and sold by TOKIN Corporation, Sendai, Japan. A pair of driving electrodes is formed on an opposing pair of longitudinal side surfaces of each piezoelectric electrode piece 13 by thick silver-paradium layers. The piezoelectric electrode pieces 13 are attached to the first through the fourth side surfaces of the resilient substrate 11 with a hard adhesive and with one of the driving electrodes interposed. The piezoelectric electrode pieces are preliminarily poled in a direction perpendicular to the driving electrodes 13. In this manner, the piezoelectric electrode pieces 13 serve as piezoelectric driving electrode pieces and are herein often so called. The printer head has an overall height of about 6 mm.

Figure 4:
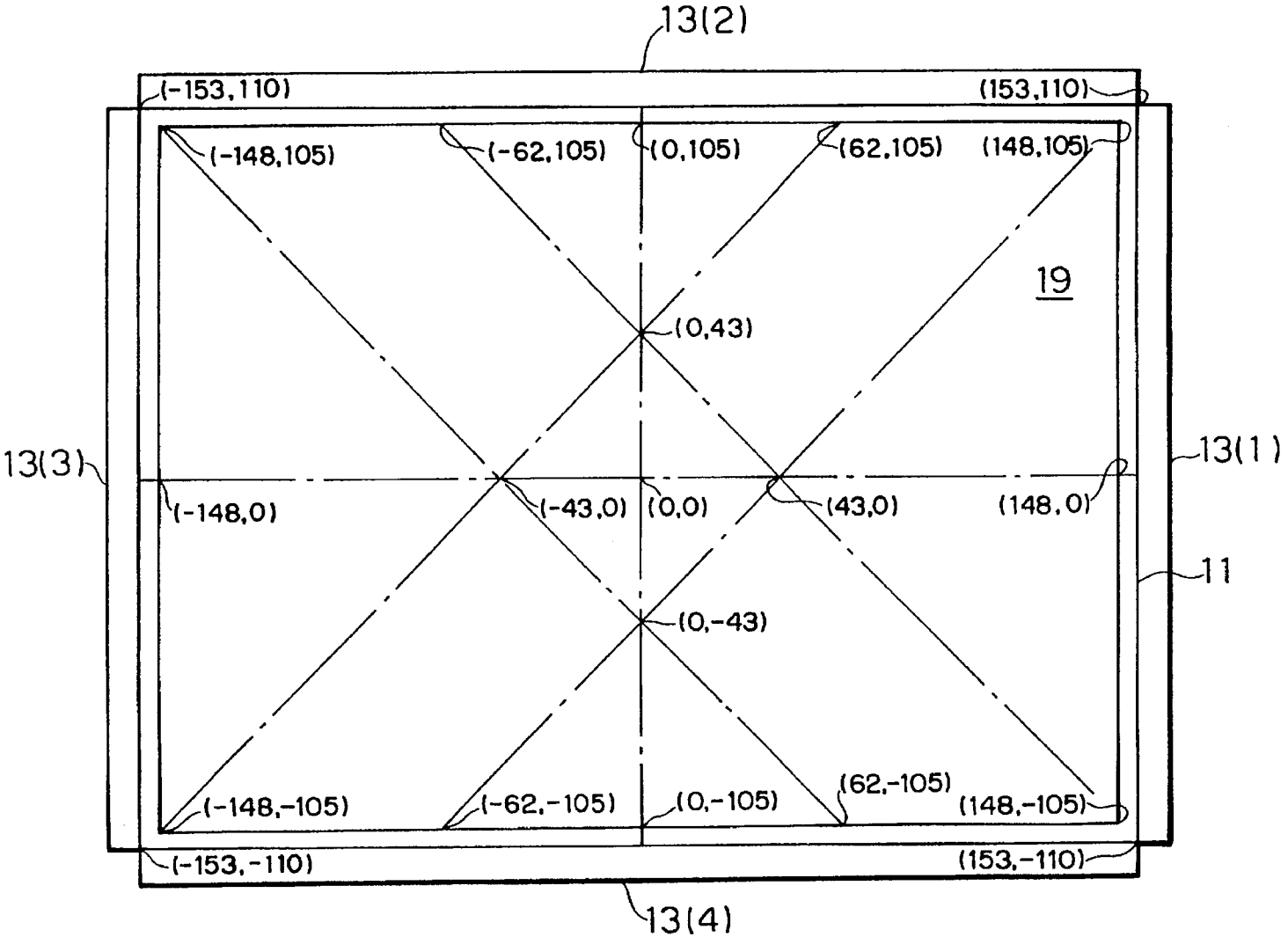
FIG. 4 is a partial top view of the printer head depicted in FIG. 1 with coordinates.

Referring to FIG. 4 and again to FIGS. 1 through 3, an X-Y right-hand orthogonal coordinate system is taken into consideration on the voltage responsive film 19 The coordinate system has an origin (0, 0) at a center of the voltage responsive film 19. In correspondence to the length and the width of 296 mm and 210 mm, the abscissa ranges between plus 148 and minus 148. The ordinate is variable between plus 105 and minus 105. Diagonal dash-dot lines show relation between the abscissae and the ordinates.

Figure 5:
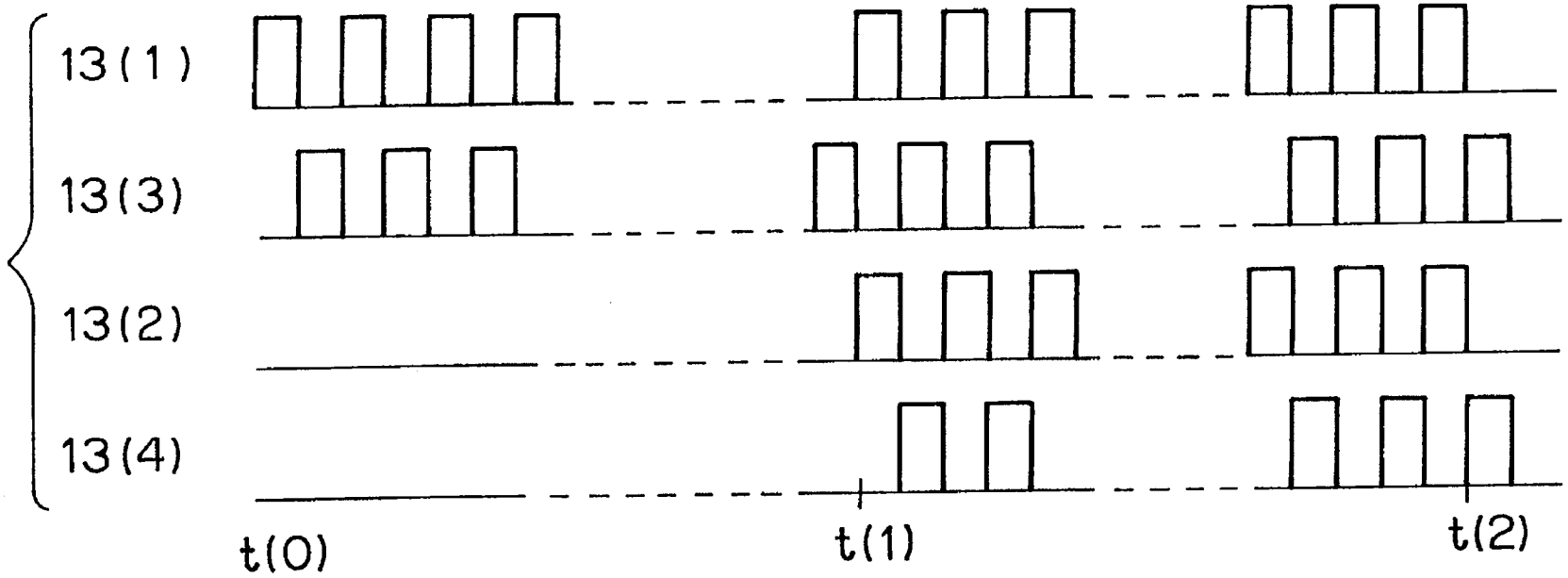
FIG. 5 schematically shows a driving signal for use in putting the printer head of FIG. 1 in operation.

Turning to FIG. 5 with FIGS. 1 through 4 continuously referred to, initial residual polarization is given to the voltage responsive film 19 with its polarity directed downwardly in FIG. 1 towards the resilient substrate 11, namely, with a negative polarity given along an upper surface of the voltage responsive film 19 in FIG. 3. For this purpose, a driving signal of increasing sawtooth pulses is supplied to a piezoelectric driving electrode member 13 consisting of the first through the fourth piezoelectric driving electrode pieces 13 as follows. It should be noted that each increasing sawtooth pulse is depicted in FIG. 5 as a rectangular pulse merely for simplicity of illustration. For example, each pulse builds up to a peak voltage of 12 volts in 4.836 ns and builds down in 0.537 ns.

Irrespective of the shape of pulses, such a driving signal produces a travelling elastic or acoustic wave which starts at one of the piezoelectric driving electrode pieces 13 supplied with the pulses towards an opposing one of the piezoelectric driving electrode pieces 13. The travelling elastic wave is propagated along a line or each of lines colinear with a first point of the piezoelectric driving electrode pieces 13 where each pulse builds up and down and with a second point which the opposing one of the piezoelectric driving electrode pieces 13 has in correspondence to the first point. It will be presumed for the time being that the pulses build up and down at one of the piezoelectric driving electrodes 13 concurrently throughout its whole length.

In FIG. 5, a first partial voltage of the driving signal is supplied between the first and the third piezoelectric driving electrode pieces 13(1) and 13(3) in the manner depicted along a top or first row and a second row indicated by legends 13(1) and 13(3) used as the reference numerals. Supply of the first partial voltage starts at a zeroth time instant t(0). At a first time instant t(1) later by 37,911 microseconds than the zeroth time instant t(0), a first travelling elastic wave arrives from the first piezoelectric driving piece 13(1) at a point (–43, 0) in FIG. 4. From this time instant t(1), a second partial voltage of the driving signal is supplied between the second and the fourth piezoelectric driving electrode pieces 13(2) and 13(4) as depicted in FIG. 5 along a third and a fourth or bottom row with legends 13(2) and 13(4) of the reference numerals to produce a second travelling elastic wave. At a second time instant t(2) later by 58.22 microseconds from the zeroth time instant t(0), the first and the second travelling elastic waves cover whole of the voltage responsive film 19.

Between the zeroth and the second time instants t(0) and t(2), the first partial voltage consists of 5,328 pulses. Between the first and the second time instants t(1) and t(2), the second partial voltage consists of 3,780 pulses.

The first and the second elastic travelling waves give a strain or tension and compression in the strain responsive film 17 and an electric voltage therein in conformity with the strain. The electric voltage gives rise to residual electric polarization as initial residual polarization in the voltage responsive film 19. This initial residual polarization will become clear as the description proceeds. At the second time instant t(2), the initial residual polarization is given rise to at a pitch of 55.56 micrometers both vertically and horizontally of FIG. 2.

The peak voltage of 12 volts is determined by experiments preliminarily carried out by using the printer head being illustrated. It has been confirmed by the experiments that an elastic oscillation results from the driving signal supplied to the piezoelectric driving electrode pieces 13 to produce the electric voltage in the strain responsive film 17 at quadruple points of strain produced by the elastic oscillation with the electric voltage made to give rise to the initial residual polarization in the voltage responsive film 19 and with the initial residual polarization invertible in the manner which will later be described. Produced by the elastic oscillation in the strain responsive film 17, the electric voltage has an electric field intensity which is greater than a quarter of a residual electric field of the voltage responsive film 19 and is less than a half of the residual electric field.

Figure 6:
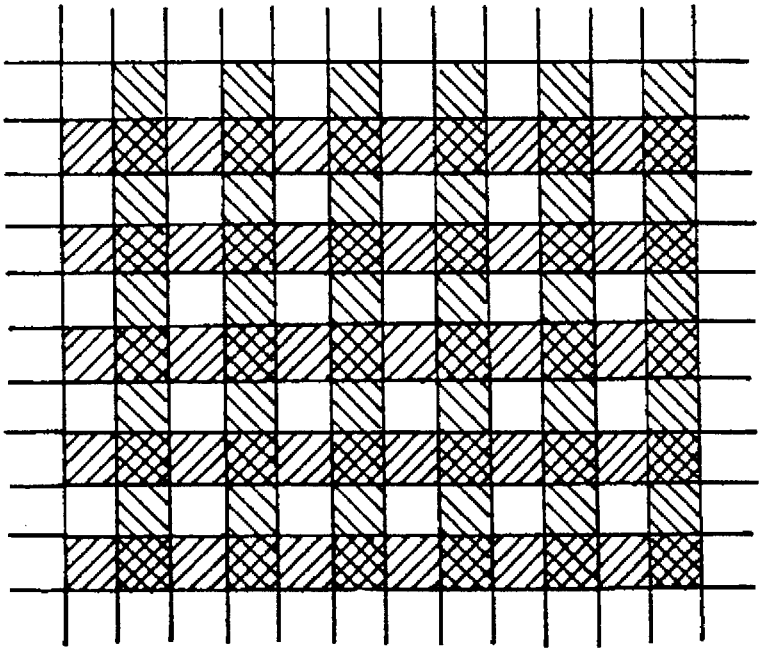
FIG. 6 schematically shows in detail an adjacency of (0, 0) of the coordinates depicted in FIG. 4.

Further turning to FIG. 6 with FIGS. 1 through 5 continuously referred to, the first partial voltage will now be called a main scan voltage. The second partial voltage will be called an auxiliary scan voltage. It will be presumed that the main scan voltage is supplied to the first and the third piezoelectric driving electrode pieces 13(1) and 13(3) line by line as in main scan known in the art. Meanwhile, the auxiliary scan voltage is supplied to the second and the fourth piezoelectric driving electrode sections 13(2) and 13(4) as in auxiliary scan once while the main scan voltage is supplied along the first and the third piezoelectric driving electrode pieces 13(1) and 13(3). The travelling elastic wave is produced in the resilient substrate 11 line by line along the lower, the common, and the upper electrode layers 21, 23, and 25 by causing the main scan voltage to scan the first and the third piezoelectric driving electrode pieces 13 along their lengths in synchronism with propagation of the elastic wave from the first or the third piezoelectric driving electrode piece 13 to the third or the first piezoelectric driving electrode piece 13.

After an area of the printer head, such as of the voltage responsive film 19, comes to an end, the initial residual polarization is given to only one fourth of the area. Picture cells or elements of the area are defined by the upper electrode layers 25. Attention is directed in FIG. 6 to the picture cells of a small area, such as near the origin (0, 0) depicted in FIG. 4.

The main scan voltage gives rise to main-scan residual polarization at picture cells indicated by rightwardly rising hatches. The auxiliary scan voltage produces auxiliary scan residual polarization at picture cells indicated by leftwardly rising hatches. In cooperation, the main and the auxiliary scan voltages to picture cells which are the quadruple points and are indicated by crossed hatches. It is understood in this case that the initial residual polarization is given to only a quarter of the picture cells.

The main scan voltage is therefore again supplied to the first and the third piezoelectric driving electrode pieces 13(1) and 13(3) with its polarity reversed and with the auxiliary scan voltage supplied as it stands. Subsequently, the auxiliary scan voltage is supplied to the second and the fourth piezoelectric driving electrode pieces 13(2) and 13(4) with its polarity reversed and with the polarity of the main scan voltage again reversed. With this repetition of polarity reversal, the initial residual polarization is given to all of the voltage responsive film 19.

It should furthermore be noted that reverberation must be erased during the polarity reversal. For this erasure, a driving signal of decreasing sawtooth pulses is used wherein each pulse builds Up to the peak voltage of 12 volts in 0.537 ns and builds down in 4.836 ns. In the manner described before, the driving signal of the increasing sawtooth pulses covers the length of the strain and the voltage responsive films 17 and 19 in 58.22 microseconds. Supply of the driving signal of the decreasing sawtooth pulses to the third piezoelectric driving electrode piece 13(3) is therefore started with the timing depicted in FIG. 5 along the first row 13(1) at a time instant 59.1876 microseconds after start of supply of the main scan signal. Further 0.5373 ns later, supply of the driving signal of the decreasing sawtooth pulses to the first piezoelectric driving electrode piece 13(1) is started with the timing depicted in FIG. 5 along the second row 13(3). Results of erasure was confirmed to be satisfactory by no attachment of an electrostatic toner with particle surfaces charged either positive or negative.

Figure 7:
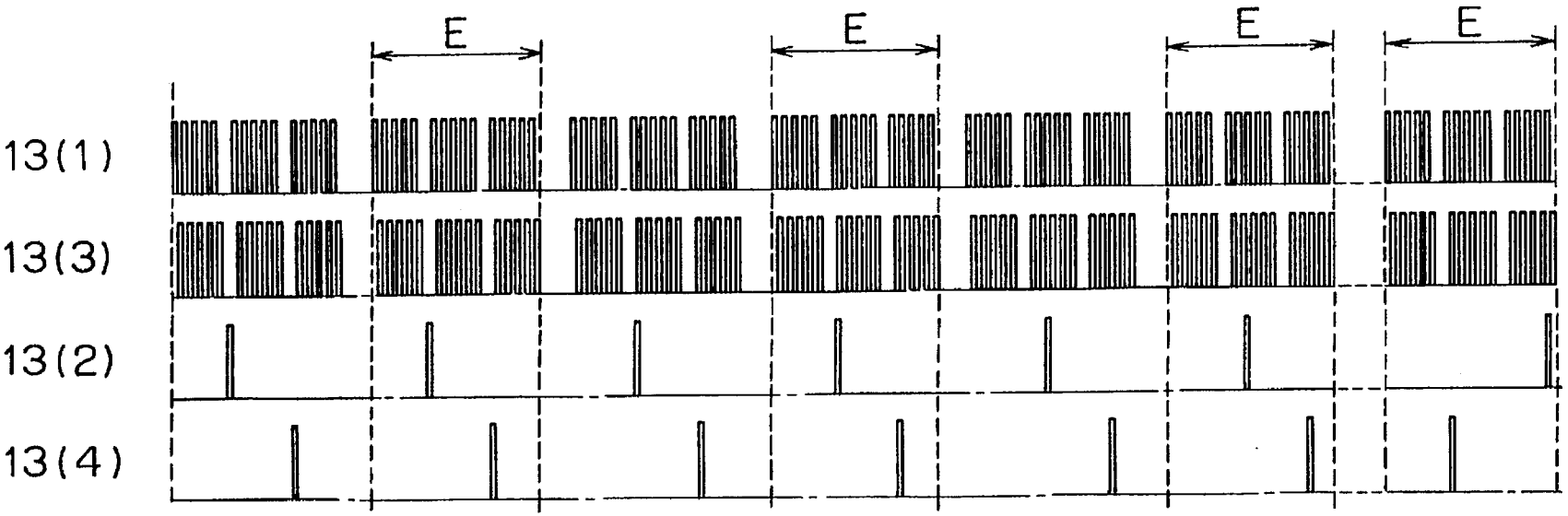
FIG. 7 is a schematic time chart of a driving signal for use in producing a latent image on the driving head illustrated in FIG. 1.

Referring now to FIG. 7 with FIGS. 1 through 5 continuously referred to, the initial residual polarization is inverted into the inverted residual polarization in conformity with an image which should be printed. An image signal is used as the main scan signal. A selection signal is used as the auxiliary scan signal. The image and the selection signal represent the image. The image signal is supplied along the first and the third piezoelectric driving electrode pieces 13 line by line and is modulated in accordance with a pattern which should be produced as an area of the inverted residual polarization in the initial residual polarization.

In FIG. 7, the image signal is supplied to the first piezoelectric driving electrode piece 13(1) with timings depicted along a first or top row with the legend 13(1) and to the third piezoelectric driving electrode piece 13(3) with timing depicted along a second row with the legend 13(3). Vertical dashed lines are indicative of an auxiliary scan interval which corresponds to a horizontal scan period in image or picture reproduction. The selection signal is supplied to the second and the fourth piezoelectric driving electrode pieces 13(2) and 13(4) with timings illustrated along a third and a fourth or bottom row with legends 13(2) and 13(4).

The image signal has different pulse shapes in a writing interval and a reverberation erasing interval E. The image signal of the writing interval and the selection signal have the decreasing sawtooth pulses. The image signal is given the increasing sawtooth pulses during each erasing interval. In order to give rise to strongly inverted residual polarization, the polarity reversal is used as described before. In an area of the initial polarization where the voltage responsive film 19 has a top surface given the negative polarity, the inverted residual polarity is produced in accordance with the image as a latent image of a positive polarity.

Reverting to FIG. 1 above all among FIGS. 1 through 7, the inverted residual polarization is produced in the voltage responsive film 19 in its thickness direction with an area of its exposed surface or of a common outer surface of the upper electrode layers 25 given a positive polarity in the example being illustrated. The area serves as an electrostatic latent image of a pattern which is represented By the image signal and the selection signal in cooperation which signals are described in conjunction with FIG. 7 and are supplied to a piezoelectric driving electrode member 13 collectively as a driving signal. This polarity is herein called a first polarity.

On developing the latent image into a positive or developed image, an electrostatic toner is supplied to the toner supplier, namely, to the aluminium plate 15 which is preferably slightly tilted to utilize the gravity in feeding the toner to a first end of the voltage responsive film 19 near the toner supplier 15. The toner should preliminarily be given, in the known manner, an electrostatic negative charge to its particle surfaces. Thus changed, the toner is herein referred to as having a second polarity.

While supplying a small quantity of the toner, the first and the third piezoelectric driving electrode pieces 13(1) and 13(3) are supplied with sinusoidal signals having a slight phase difference. Like the driving signal and the image and the selection signals described before, the sinusoidal signals give rise to a travelling elastic wave through the resilient substrate 11. This makes the toner move towards a second end which the voltage responsive film 19 has opposite to the first end near the third piezoelectric driving electrode piece 13(3) when the toner supplier 15 is placed over the first piezoelectric driving electrode piece 13(1) in the manner depicted in FIG. 1. The phase difference is selected to give this forward movement to the toner.

While moving along the voltage responsive film 19 or the upper electrode layers 25, the toner electrostatically adheres to the area where the voltage responsive film 19 is subjected to the inverse residual polarization to develop the latent image to the positive image and to leave a part of the toner unattached to the area as excessive or remaining toner. When a leading end line of the excessive toner reaches the second end, the sinusoidal signals are given reversed phases. This causes a backward movement of the excess toner towards the toner supplier 15.

when it is desired to print the positive image on a sheet of paper as a printed or transferred pattern, the paper is pressed as usual to the printer head, namely, to the voltage responsive film or the upper electrode layers 25. In this event, the image signal should represent the pattern with this print of the positive image to the paper. By heating the printer head in the known manner and thereby the paper to about 150° C. on its surface brought into contact with the printer head, the positive image is printed on the paper. It is possible to use a recording medium in place of the paper. After print, the inverted residual polarization is preferably erased in preparation for subsequent use of the printer head by again forming the initial residual polarization throughout the voltage responsive film 19 with erasure of the reverberation.

Sheets of paper of the ISO A4 size were used to test resolution of the printed image. A standard test pattern was used. It has been confirmed that the printed image has a resolution of at least 450 DPI. On the average, the inverted residual polarization was produced in 1.747 seconds. It took 0.3 second to supply the toner and to collect the excess toner. The paper was put in place, given the printed image with heating, and then taken out in 0.45 second. It took about 2.5 seconds in total.

Figure 8:
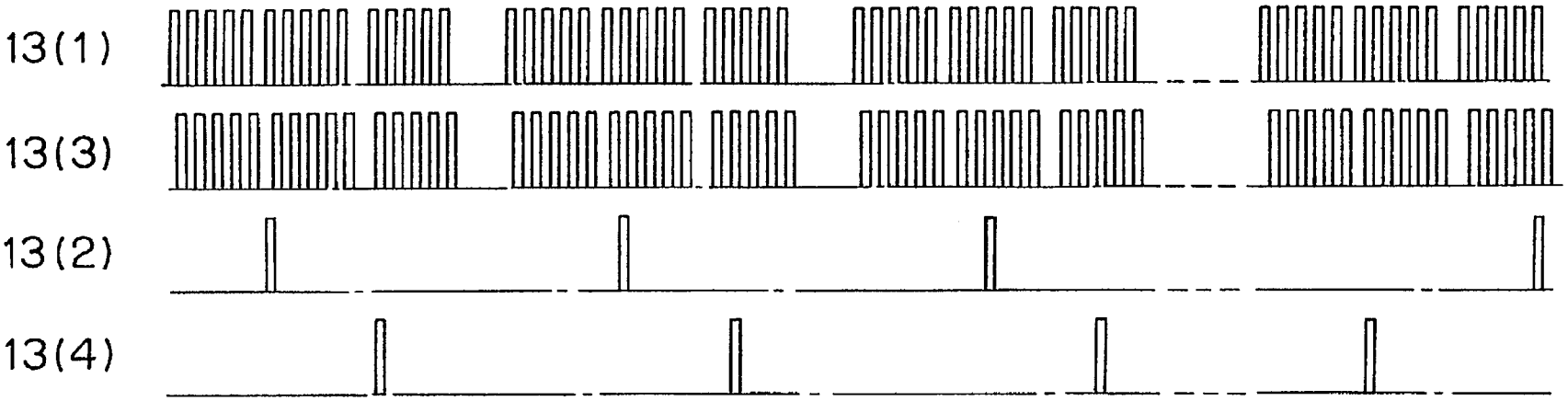
FIG. 8 schematically shows a driving signal used experimentally in place of the driving signal depicted in FIG. 7.

Referring temporarily to FIG. 8 and again to FIG. 7 above all among FIGS. 1 through 7, the piezoelectric driving electrode pieces 13 are supplied with no use of the erasing intervals described in connection with FIG. 7. It is possible to shorten by 1 second the time necessary to get the latent image. The resolution is, however, poor.

Figure 9:
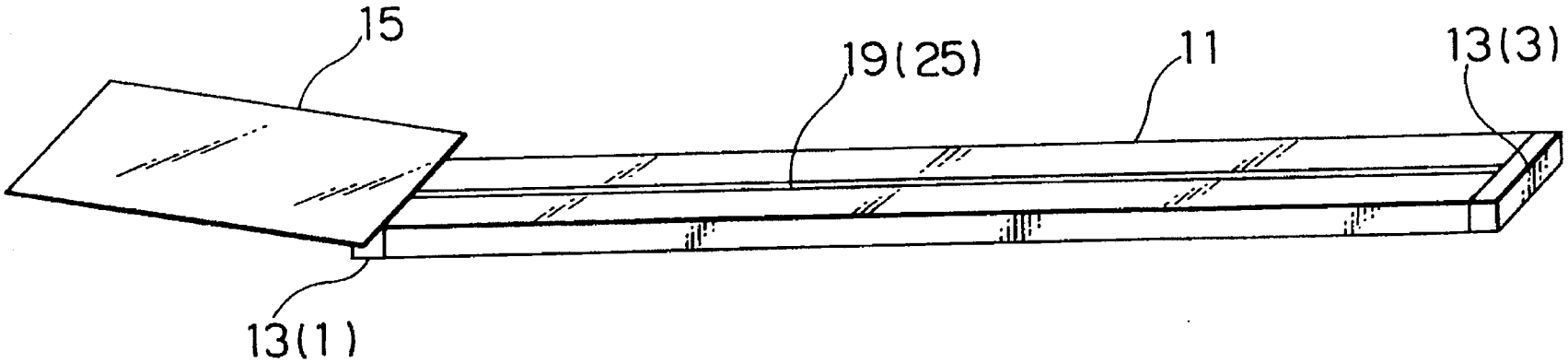
FIG. 9 is a perspective view of a printer head of a printer according to a second embodiment of this invention.

Referring now to FIG. 9, attention will be directed to a printer head of a printer according to a second embodiment of this invention. Similar parts are designated by like reference numerals and are similarly operable with similarly named signals or voltages. This printer head is for use in a line printer.

The resilient substrate 11 has a narrow width. Only the first and the third piezoelectric driving electrode pieces 13(1) and 13(3) are used among the first through the fourth piezoelectric driving electrode pieces 13 described in conjunction with FIG. 1 The stack of two ferroelectric films is similar in structure to that illustrated with reference to FIGS. 2 and 3. The stack, however, comprises only one line of the lower, the common, the upper, and the connection electrode layers 1, 23, 25, and 27. In FIG. 9, only the voltage responsive film 19 or the upper electrode layers 25 are visible.

Supplied with the driving signal of the type described in connection with FIG. 5 along the first and the second rows with the legends 13(1) and 13(3), the voltage responsive film 19 is subjected to the initial polarization. Subsequently supplied with the image signal modulated with a linear pattern and further with a reverberation erasing signal in the manner described with reference to FIGS. 6 and 7, the initial residual polarization is inverted into the inverted residual polarization representative of a linear latent image of the linear pattern. Thereafter, the latent image is developed into a linear positive or developed pattern.

It is possible to use the line printer in printing not only the linear positive pattern on a sheet of paper but also a positive pattern having an area. For printing a pattern having an area on a sheet of paper, the positive or developed image of a line must first be printed on the paper. Thereafter, the inverse residual polarization is erased by afresh giving the initial residual polarization to the printer head for print or transfer of the positive image of a next line on the paper. In this manner, the pattern must be printed on the paper line by line. It therefore takes 18 minutes to complete print on a sheet of paper of the ISO A4 size with the resolution of about 400 DPI.

Reviewing FIGS. 1 through 9, it has been confirmed that the printer head is operable with the resolution of 450 DPI in a temperature range between 10° C. and 40° C. when the resilient substrate 11 is made of borosilicate glass. It is possible instead to make the resilient substrate 11 of an alloy of iron (52%), nickel (36% or less), and chromium (12%) which may additionally include tungsten (2%) and manganese, silicon, and carbon (each about 1%) to be known as Elinvar and has as low a temperature coefficient as 0.1% of the elastic wave between minus 20° C. and plus 60° C. Use was made of a 1-mm thick plate of this alloy with its surface buff polished to a surface smoothness of less than 0.1 micrometer. silicon dioxide film was evaporated onto the surface to a thickness of 1000 angstroms for formation of the stack of two ferroelectric films 17 and 19 and the lower, the common, the upper, and the connection electrode layers 21, 23, 25, and 27 thereon. The printer head had a resolution of 450 DPI between minus 20° C. and plus 60° C.

It may appear that operation of the printer head is complicated and troublesome. It is, however, possible for practical use in accordance with the foregoing to preliminarily make the power supply arrangement to control supply of the driving signal to the piezoelectric driving electrode member 13 with polarity reversal for formation of the initial residual polarization, line by line supply of the image signal and supply of the selection signal followed by supply of the reverberation erasing signal for production of the inverted residual polarization, supply and phase reversal of the sinusoidal signal accompanied by charging of the toner for development of the latent image, preliminary heating and modification of the image signal for print of the positive image, and subsequent supply and polarity reversal of the driving signal in afresh giving the initial residual polarization. Papers and/or secondary mediums are fed to the printer head and taken out thereof in the known manner.

While this invention has thus far been described in specific conjunction with only a few preferred embodiments thereof, it will now be readily possible for one skilled in the art to put this invention into practice in various manners. For example, the materials of various components and the numerical values are not restricted to those described above provided that the printer head and the developing method come under the scopes of the appended claims.

What is claimed is:

1. A printer comprising a primer head comprising:

a resilient substrate;

a strain-responsive film, comprising a first ferroelectric material, positioned on said substrate;

a voltage-responsive film, comprising a second ferroelectric material, positioned on said strain-responsive film to form a stack of ferroelectric films; and a piezoelectric driving electrode member, connected to said stack of ferroelectric films, responsive to an external driving signal, representative of a pattern for inverting an initial residual polarization in said voltage-responsive fill into an inverted residual polarization in a first direction of said voltage-responsive film, for allowing an area of the inverted residual polarization to serve as a latent image of said pattern.

2. A printer as claimed in claim 1, said resilient substrate having a pair of first and second end surfaces, wherein said piezoelectric driving electrode member comprises first and second piezoelectric driving electrode pieces attached to said first and said second end surfaces, respectively, said driving signal being supplied to said first and said second piezoelectric driving electrode pieces to produce, in said resilient substrate, a traveling elastic wave traveling from said first piezoelectric driving electrode piece to said second piezoelectric driving electrode piece, said traveling elastic wave producing, in said strain-responsive film, a strain and an electric voltage, said electric voltage inverting, in said voltage-responsive film, said initial residual polarization into said inverted residual polarization.

3. A printer as claimed in claim 2, said resilient substrate further having a pair of third and fourth end surfaces, each being perpendicular to both said first and said second end surfaces, said traveling elastic wave being a first traveling elastic wave, said strain being a first strain, said electric voltage being a first electric voltage, wherein said piezoelectric driving electrode member further comprises third and fourth piezoelectric driving electrode pieces attached to said third and said fourth end surfaces, respectively, said driving signal being supplied also to said third and said fourth piezoelectric driving electrode pieces to produce, in said resilient substrate, a second traveling elastic wave traveling from said third piezoelectric driving electrode piece to said fourth piezoelectric driving electrode piece, said second traveling elastic wave producing, in said strain-responsive film, a second strain and a second electric voltage, said second electric voltage inverting, in said voltage-responsive film, said initial residual polarization in cooperation with said first electric voltage into said residual polarization.

4. A printer as claimed in claim 3, wherein each pair of said first and said second piezoelectric driving electrode pieces and each pair of said third and said fourth piezoelectric driving electrode pieces is supplied with an initial voltage, for establishing said initial residual polarization, before being supplied with said driving signal to produce, in said resilient substrate, a first and a second initial elastic wave, different than said first traveling elastic wave and said second traveling elastic wave, traveling from said first piezoelectric driving electrode piece to said second piezoelectric driving electrode piece and from said third piezoelectric driving electrode piece to said fourth piezoelectric driving electrode piece, respectively, said first and said second initial elastic waves producing, in cooperation with said piezoelectric driving electrode member, in said strain-responsive film, an initial strain and an initial electric voltage, said initial electric voltage producing, in said voltage-responsive film, said initial residual polarization.

5. A printer as claimed in claim 4, wherein said first initial elastic wave and said second initial elastic wave has a strength for producing, in said voltage-responsive film, an initial electric field having a strength of one-quarter of said initial electric voltage, said one-quarter of initial electric voltage being greater than a quarter of a residual electric field of said voltage-responsive film and being less than a half of said residual electric field.

6. A printer as claimed in claim 5, wherein said first ferroelectric material is lead zirconate titanate, said second ferroelectric material being lead lanthanum zirconate titanate.

7. A printer as claimed in claim 5, said resilient substrate having a length between said first and said second end surfaces and a width less than a length between said third and said fourth end surfaces, wherein said first and said second piezoelectric driving electrode pieces are supplied with said initial electric voltage before said initial electric voltage is supplied to said third and said fourth piezoelectric driving electrode pieces so that said first and said second initial elastic waves concurrently arrive at said second and said fourth piezoelectric driving electrode pieces.

8. A printer as claimed in claim 7, wherein said first piezoelectric driving electrode piece and said second piezoelectric driving electrode piece are supplied with a reverberation erasing signal before being supplied with said driving signal and after being supplied with said first and said second initial elastic waves at said second and said fourth piezoelectric driving electrode pieces to erase reverberation of said first and said second initial elastic signals at said second and said fourth piezoelectric driving electrode pieces.

9. A primer as claimed in claim 4, said strain and said voltage-responsive films having first, second, third, and fourth common side surfaces, each being respectively parallel to and inwardly of said first through said fourth end surfaces, wherein said stack comprises lower electrode layers between said strain-responsive film and said resilient substrate, common electrode layers between said strain and said voltage-responsive films, and upper electrode layers on said voltage-responsive film so that said lower, said common, and said upper electrode layers define an array of picture cells between said first and said second side surfaces and between said third and said fourth side surfaces, said driving signal being supplied along said first and said second piezoelectric driving electrodes to successively invert said initial residual polarization into said inverted residual polarization at said picture cells from said third side surface to said fourth side surface during a scan interval as an image signal representative of said pattern, said driving signal being supplied to said third and said fourth piezoelectric driving electrode pieces to invert said initial polarization into said inverted residual polarization in cooperation with said image signal.

10. A printer as claimed in claim 9, wherein said image signal produces, in said resilient substrate, said first traveling wave from said first piezoelectric driving electrode piece to said second piezoelectric driving electrode piece at said picture cells successively from said third side surface to said fourth side surface during said scan period, said first and said second piezoelectric driving electrode pieces being supplied with a reverberation erasing signal following said scan interval successively along said first and said second piezoelectric driving electrode pieces to erase reverberation of said first traveling wave at said second piezoelectric driving electrode piece.

11. A printer as claimed in claim 2, wherein said first and said second piezoelectric driving electrodes are supplied with an initial voltage, for establishing said initial residual polarization, before being supplied with said driving signal to produce, in said resilient substrate, first and second initial elastic waves, different than said traveling elastic wave traveling from said first piezoelectric driving electrode piece to said second piezoelectric driving electrode piece and from said second piezoelectric driving electrode piece to said first piezoelectric driving electrode piece, said first and second initial elastic waves producing, in cooperation with said piezoelectric driving electrode member, in said strain-responsive film an initial strain and an initial electric voltage, said initial electric voltage producing, in said voltage-responsive film, said initial residual polarization.

12. A printer as claimed in claim 11, wherein each of said first and said second initial elastic waves has a strength for producing, in said voltage-responsive film, an initial electric field having a strength of one-half of said initial electric voltage, said one-half of initial electric voltage being greater than a half of a residual electric field of said voltage-responsive film and less than said residual electric field.

13. A printer as claimed in claim 12, wherein said first ferroelectric material is lead zirconate titanate, said second ferroelectric material being lead lanthanum zirconate titanate.

14. A printer as claimed in claim 11, wherein said first and said second piezoelectric driving electrode pieces are supplied with a reverberation erasing signal before being supplied with said driving signal and after being supplied with said first and said second initial elastic waves at said second and said first piezoelectric driving electrode pieces to erase reverberation of said first and second initial elastic wave at said second and said first piezoelectric driving electrode pieces.

15. A primer as claimed in claim 2, said stack having first and second ends positioned inwardly of said first and said second end surfaces, wherein said stack comprises lower electrode layers between said strain-responsive film and said resilient substrate, common electrode layers between said strain and said voltage-responsive films, and upper electrode layers on said voltage-responsive film so that said lower, said common, and said upper electrode layers define a line of picture cells between said first and said second end surfaces, said driving signal successively inverting said initial residual polarization into said inverted residual polarization in conformity with said pattern at said picture cells.

16. A printer as claimed in claim 2, said driving signal producing in said resilient substrate, first and second traveling elastic waves traveling from said first piezoelectric driving electrode piece to said second piezoelectric driving electrode piece and from said second piezoelectric driving electrode piece to said first piezoelectric driving electrode piece, said first and said second piezoelectric driving electrode pieces being supplied with a reverberation erasing signal after being supplied with said first and said second traveling elastic waves at said second and said first piezoelectric driving electrode pieces to erase reverberation of said first and said second traveling elastic waves at said second and said first piezoelectric driving electrode pieces.

17. A printer as claimed in claim 1, said voltage-responsive film being subjected to said inverted residual polarization with a first polarity, said printer further comprising means for supplying a first film end of said voltage-responsive film with an electrostatic toner having a second polarity, opposite said first polarity, for transferring said toner on said voltage-responsive film to a second film end of said voltage-responsive film, opposite to said first film end, for allowing said toner adhere to said latent image.

18. A printer as claimed in claim 17, said resilient substrate having a first substrate end and a second substrate end, said first and said second film ends being adjacent to said first and said second substrate ends, wherein said toner supplying means comprises:

a toner supplier positioned adjacent said first film end for supplying said toner to said first film end; and first and second piezoelectric driving electrode pieces attached to said first and said second substrate ends, collectively functioning as said piezoelectric driving electrode member and being supplied with first and second signals having a phase difference for producing a traveling elastic wave, in said resilient substrate, and for transferring said toner to said second film end.

19. A printer as claimed in claim 18, said toner including, on reaching said second film end, an excess toner which is not attached to said latent image, wherein said first and said second piezoelectric driving electrode pieces are supplied, after arrival of said excess toner at said second film end, with said first and said second signals having reverse phases for producing a reverse traveling elastic wave, in said resilient substrate, for transferring said excess toner to said toner supplier.

20. A method of developing a latent image produced as a pattern of inverted residual polarization with a first polarity in a first direction of a voltage-responsive film of a first ferroelectric material stacked on a strain-responsive film of a second ferroelectric material formed on a resilient substrate as a stack of ferroelectric films of a printer head in cooperation with said voltage-responsive film by a piezoelectric driving electrode member, said method comprising steps of;

supplying said stack with a driving voltage representative of said pattern:

inverting an initial residual polarization in conformity with said pattern; and supplying an electrostatic toner of a second polarity opposite to said first polarity onto said voltage-responsive film.

* * * * *